US005777190A

United States Patent [19]

Shah et al.

[11] Patent Number: 5,777,190

[45] Date of Patent: Jul. 7, 1998

[54] METHOD OF CONTROLLED REDUCTION OF NITROAROMATICS BY ENZYMATIC REACTION WITH OXYGEN SENSITIVE NITROREDUCTASE ENZYMES

[75] Inventors: Manish M. Shah, Richland; James A. Campbell, Pasco, both of Wash.

[73] Assignee: Battelle Memorial Institute, Richland, Wash.

[21] Appl. No.: 865,140

[22] Filed: May 29, 1997

[51] Int. Cl.[6] ..... A62D 3/00

[52] U.S. Cl. ..... 588/202; 435/262.5; 210/632

[58] Field of Search ..... 588/202; 435/262.5; 210/632

[56] References Cited

U.S. PATENT DOCUMENTS 4,756,832 7/1988 Gold et al. ..... 210/632

5,051,184 9/1991 Taylor ..... 210/632

OTHER PUBLICATIONS

Purificatiion and Characterization of Nitrobenzene Nitroreductase from *Pseudomonas pseudoalcaligenes* JS45, CC Somerville et al., Journal of Bacteriology, Jul. 1995, 3837–3842, American Society for Microbiology.

*Primary Examiner*—Ngoclan Mai

*Attorney, Agent, or Firm*—Douglas E. McKinley, Jr.

[57] ABSTRACT

A method for the controlled reduction of nitroaromatic compounds such as nitrobenzene and 2,4,6-trinitrotoluene by enzymatic reaction with oxygen sensitive nitroreductase enzymes, such as ferredoxin NADP oxidoreductase.

4 Claims, 5 Drawing Sheets

METHOD OF CONTROLLED REDUCTION OF NITROAROMATICS BY ENZYMATIC REACTION WITH OXYGEN SENSITIVE NITROREDUCTASE ENZYMES

This invention was made with Government support under Contract DE-AC06-76RLO 1830 awarded by the U.S. Department of Energy. The Government has certain rights in the invention.

FIELD OF THE INVENTION

The present invention relates generally to a method for the controlled reduction of nitroaromatic compounds by enzymatic reaction with oxygen sensitive nitroreductase enzymes.

BACKGROUND OF THE INVENTION

Methods for the reduction of nitroaromatic compounds have received interest as the products from the partial or total reduction those nitroaromatic compounds have found an expanding variety of uses. These uses include drug intermediates, antibiotics, pesticides, herbicides, radiosensitizers and explosives which may be produced with nitroaromatics as starting materials. As used in these applications, the nitroaromatic compounds are partially or totally reduced as part of the processing required for production of the final product.

Additionally, nitroaromatic compounds in many circumstances have proven to create environmental or health hazards. For example, nitrobenzene has been shown to cause headaches, drowsiness, nausea, vomiting and methemoglobinemia with cyanosis. Nitrobenzene has also been shown to be toxic to rats with LD50 of 640 mg/kg.

To take advantage of the potential uses of partially and totally reduced nitroaromatic compounds, and to eliminate nitroaromatic compounds in circumstances wherein they pose environmental or health risks, a variety of processing schemes have been developed to bring about the partial or total reduction of these nitroaromatic compounds. Many such schemes involve the use of naturally occurring enzymes to catalyze the reduction. Such schemes are highly advantageous as the enzymes are often readily obtainable and their use as catalysts minimizes undesirable waste and by products. An example of the use of such enzymes is provided by Sommerville (Sommerville, C., Nishino, S. F., and Spain, J. C. (1995) J. Bacteriol., 177, 3837–3842), wherein it was demonstrated that nitrobenzene may be reduced to phenylhydroxylamine through the use of oxygen insensitive nitrobenzene reductase as a catalyst. Schemes such as that described in Sommerville are characterized by an inability to control the reduction using a simple inhibitor such as molecular oxygen. However, it is often desirable that the reduction of the nitro groups not be allowed to progress to completion, as it is desirable to isolate or collect a partially reduced product. Thus, there exists a need for a catalytic method for reducing nitroaromatic compounds which may be controlled to prevent the reaction from progressing to completion.

SUMMARY OF THE INVENTION

Accordingly, it is an object of the present invention to provide a nitroreductase enzyme which will catalyze the reduction of nitroaromatic compounds. More specifically, it is an object of the present invention to provide a nitroreductase enzyme which will only catalyze the reduction of nitroaromatic compounds in the absence of oxygen. It is a further object of the present invention to provide an nitroreductase enzyme which, in the presence of oxygen, will stop the catalytic reduction. In this manner, the reduction of nitroaromatic compounds may be halted at the point at which a partially reduced product has been produced by the addition of oxygen. Oxygen may be provided either alone or in a mixture of gases such as air. The desired partially reduced product may then be isolated and utilized in a variety of end uses.

The objects of the present invention are thus accomplished by providing an "oxygen sensitive" nitroreductase enzyme which will catalyze the reduction of nitroaromatic compounds in the absence of oxygen but will not catalyze the reduction of nitroaromatic compounds in the presence of an excess of oxygen. Thus, "oxygen sensitive" enzymes, as used herein, refers to the characteristic that in the absence of oxygen, the nitroreductase enzyme will catalyze the reduction of nitroaromatic compounds while in the presence of oxygen the nitroreductase enzyme will not catalyze the reduction of nitroaromatic compounds. Similarly, in "oxygen insensitive" as used herein, refers to the characteristic of the nitroreductase enzymes that the catalytic reduction of the nitroaromatic compounds will progress to completion regardless of the presence of oxygen. Thus, in a system wherein a nitroreductase enzyme is utilized to catalyze the reduction of nitroaromatic compounds, the use of oxygen sensitive nitroreductase enzymes affords a simple mechanism whereby the addition of oxygen will prevent the reaction from progressing to completion, and thereby allow the isolation of partially reduced products.

The present invention is thus made possible by the discovery that ubiquitous oxidoreductase enzymes found in almost all living species, such as ferredoxin NADP oxidoreductase, will catalyze the reduction of nitroaromatic compounds. While the present invention directly demonstrates the oxygen sensitive nitroreductase properties of ferredoxin NADP oxidoreductase from spinach in the reduction of nitrobenzene and 2,4,6-trinitrotoluene, the present invention is in no way limited to this specific example. Indeed, the present invention contemplates the use of any oxygen sensitive enitroreductase enzyme in the catalytic reduction of any nitroaromatic compound. Oxygen sensitive nitroreductase enzymes may thus be identified by the mechanism of reduction.

In general, the mechanism of reduction of nitroaromatic compounds by nitroreductase enzymes may be either one or two electron based. Nitroreductase enzymes that catalyze the reduction of nitroaromatics via one electron based reduction are generally oxygen sensitive. In the presence of oxygen, the oxygen sensitive nitroreductase enzymes reduce molecular oxygen to a superoxide anion radical using the nitroaromatic chemical as an electron mediator. Thus, in the presence of oxygen, oxygen sensitive nitroreductase enzymes will not catalyze the reduction of nitroaromatic compounds.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

In a preferred embodiment of the present invention, a nitroaromatic compound is combined with an oxygen sensitive nitroreductase enzyme in an environment substantially free of oxygen, thereby causing the catalytic reduction of the nitroaromatic compound. The reaction may be stopped by the addition of oxygen. Oxygen may be provided as a pure gas, or as a mixture with other gases. Thus, air is a suitable oxygen source. Nitroaromatic compounds which may be reduced by the present method thus include, but are not limited to, nitrobenzene, orthochloronitrobenzene, orthoaminophenolonitrobenzene, 2,4,6-trinitrotoluene, 2,4dinitrotoluene combinations thereof. Preferred oxygen sensitive nitroreductase enzymes are selected as having ability to catalyze reduction via a one electron based process, wherein a nitroanion radical is formed as an intermediate product in the reaction. Preferred oxygen sensitive nitroreductase enzymes would include, but are not limited to ferredoxin NADP oxidoreductase, xanthine oxidase, glutathione reductase and combinations thereof.

EXPERIMENT 1

An experiment was conducted to demonstrate the efficacy of a preferred embodiment of the present invention. Nicotinamide adenine dinucleotide phosphate reduced form (NADPH), FNR (EC 1.18.1.2) (FNR) from spinach (5.7 U/mg), and alcohol dehydrogenase (EC1.1.1.2) from Thermoanaerobium brockii, were purchased from Sigma (St. Louis, Mo.). Phenyl hydroxyl amine (PHA) was synthesized according to method listed in Vogel (1977). Under the Vogel method, nitrobenzene was reduced by using Zn dust as a catalyst. The product was separated by chromatography method. Nitrobenzene, aniline, p-aminophenol were purchased from Aldrich (Milwaukee, Wis.). All other chemicals were of analytical grade. The identity of PHA was confirmed using chemical ionization and electron impact mass spectrometry. The purity of PHA was determined to be 80% based on HPLC analysis.

An nitroreductase enzyme reaction mixture was prepared containing 0.4 units per ml of FNR, where one unit represents the reduction of substrate at the rate of 1 micromole/sec by the nitroreductase enzyme. 0.4 units per ml of ADH, 1 mM nitrobenzene, 17. mM NADPH, 100 mM isopropylalcohol, and 30 mM tris buffer at a pH of 8.5 was incubated under nitrogen in HPLC vials (2 ml) at 22° C. Stock solutions of nitrobenzene and PHA were prepared in water and methanol respectively. PHA and nitrobenzene were identified by comparison of their retention times and UV-VIS spectra with authentic standards on HPLC system with a diode array detector (HP 1090, Hewlett-Packard, Palo Alto, Calif.). A reversed phase HPLC column (ODS Ultraspere, 5 micron) with dimensions of 4.6 mm ID ×25 cm was used for separation . Methanol and water were used as the mobile phase at a ratio of 50:50 with a flow rate of 1 ml/min. The absorbance of eluents of the column was monitored at 230 nm.

Figure 1A:
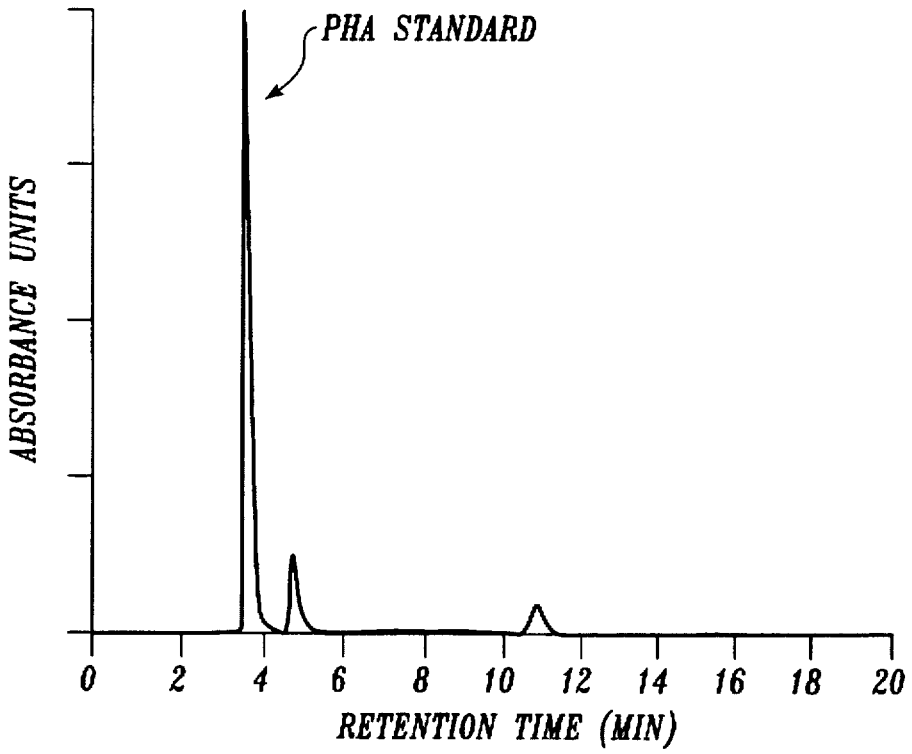
FIG. 1*a* is a chromatogram of PHA standard utilizing a chemical reduction method.
Figure 1B:
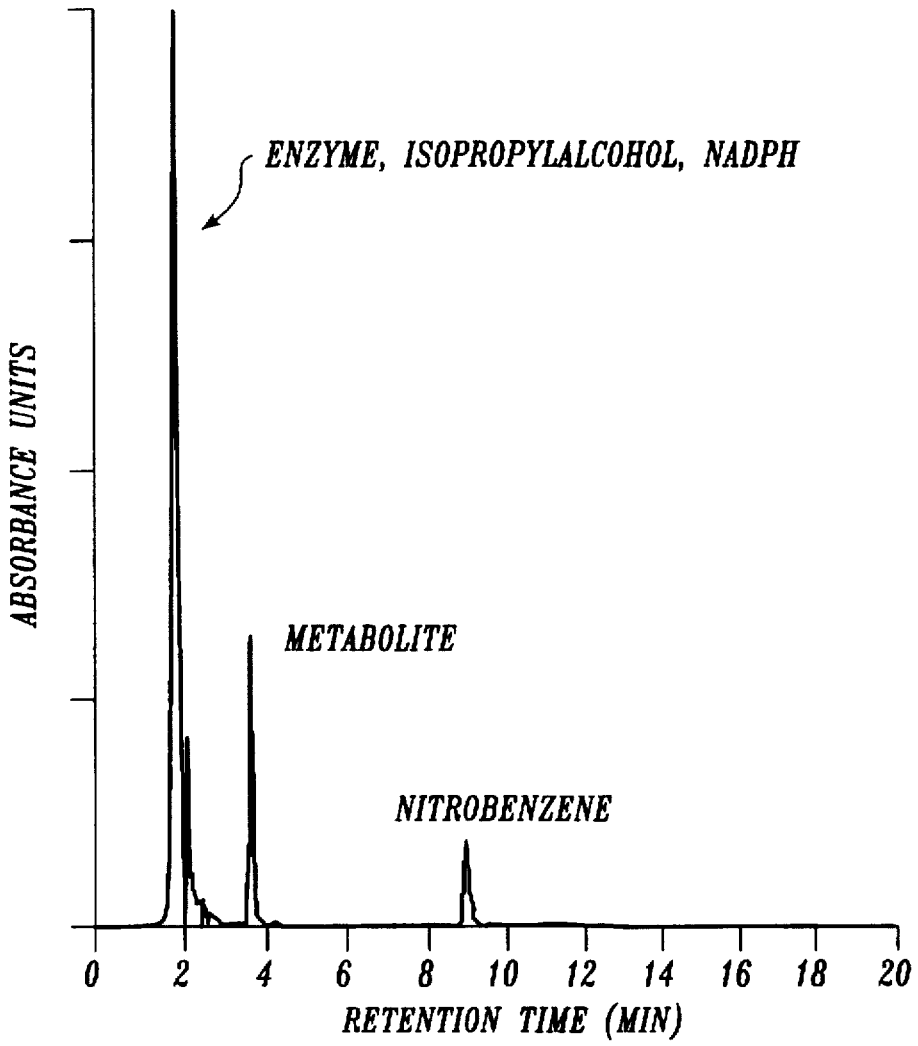
FIG. 1*b* is a chromatogram of the products of nitrobenzene enzymatically reduced with Ferredoxin NADP oxidoreductase as described in the experiment demonstrating the preferred embodiment of the present invention.
Figure 1C:
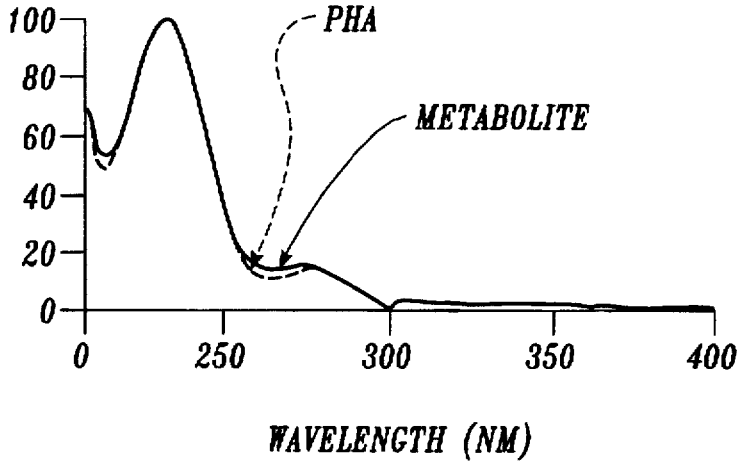
FIG. 1*c* is a UV-VIS spectrum comparing the PHA standard with the metabolite of nitrobenzene after the nitroreductase enzyme treatment described in the experiment demonstrating the preferred embodiment of the present invention.
Figure 2:
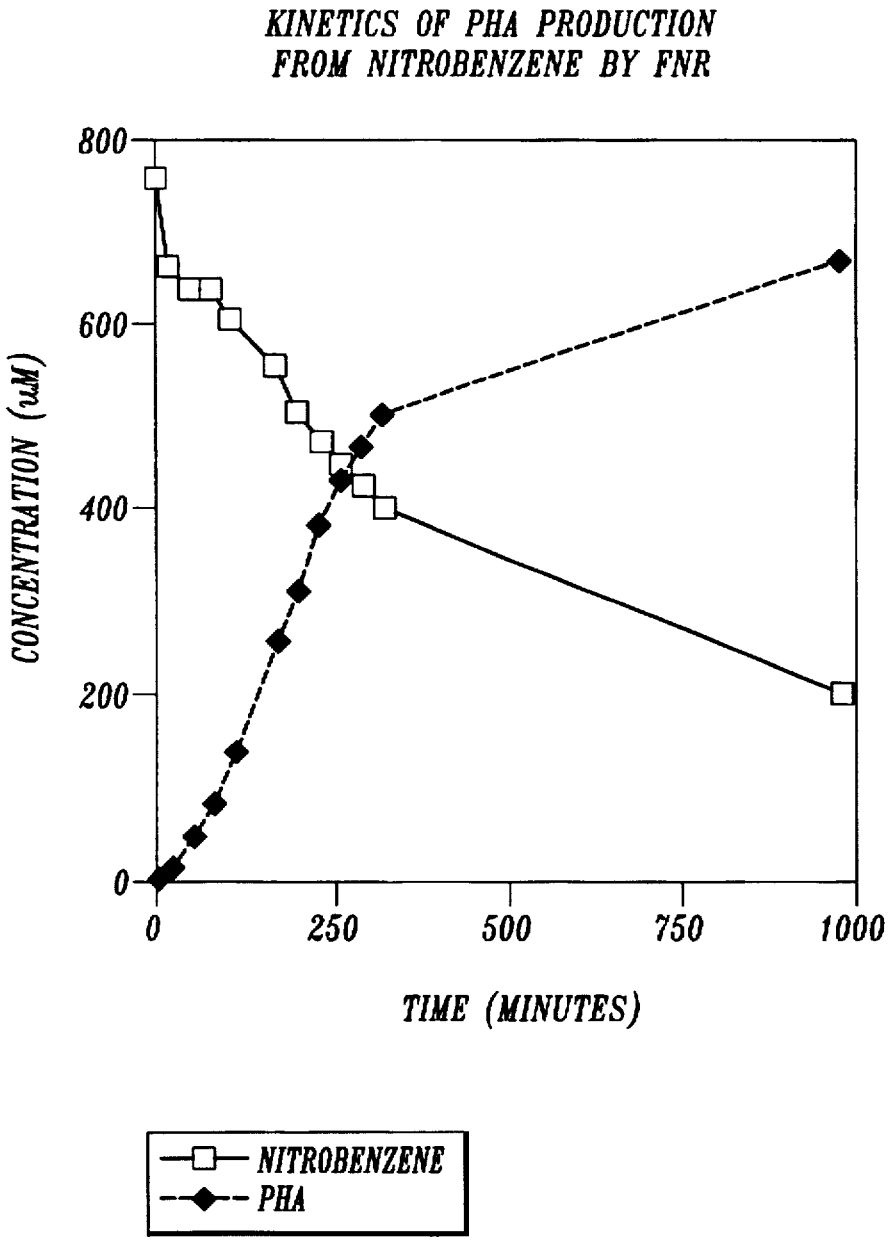
FIG. 2 is a graph showing the kinetics and stoichiometry of nitrobenzene transformation by FNR.

Isopropyl alcohol and alcohol dehydrogenase were used as the NADPH generating system. FIG. 1*a*. and FIG. 1*b*, respectively, show chromatograms of PHA standard and the reaction sample after the nitroreductase enzyme treatment as described above. FIG. 1*a*. shows the chromatogram of synthesized PHA via a chemical method. The major peak shown in FIG. 1*a* was also confirmed as PHA utilizing mass spectrometry. The other two peaks were not identified. The retention time of synthesized PHA standard matched with that obtained after the nitroreductase enzyme treatment. FIG. 1*c* then shows the matching of the UV-VIS spectrum of metabolite after the nitroreductase enzyme treatment with the PHA standard. The metabolite formed after the enzymatic treatment was identified as PHA, based on its similarity to the HPLC retention time and UV-VIS spectrum of an authentic standard. The metabolite was not detected in the absence of NADPH, FNR or nitrobenzene. The kinetics and stoichiometry of nitrobenzene transformation by FNR is shown in FIG. 2. One mole of PHA is formed for every mole of nitrobenzene.

These results demonstrate the transformation of nitrobenzene to PHA by FNR, using an oxygen sensitive nitrobenzene reductase. The reduction of nitrobenzene leads to the formation of hydroxylamine. Nitrobenzene was not reduced under aerobic conditions.

EXPERIMENT 2

Figure 3:
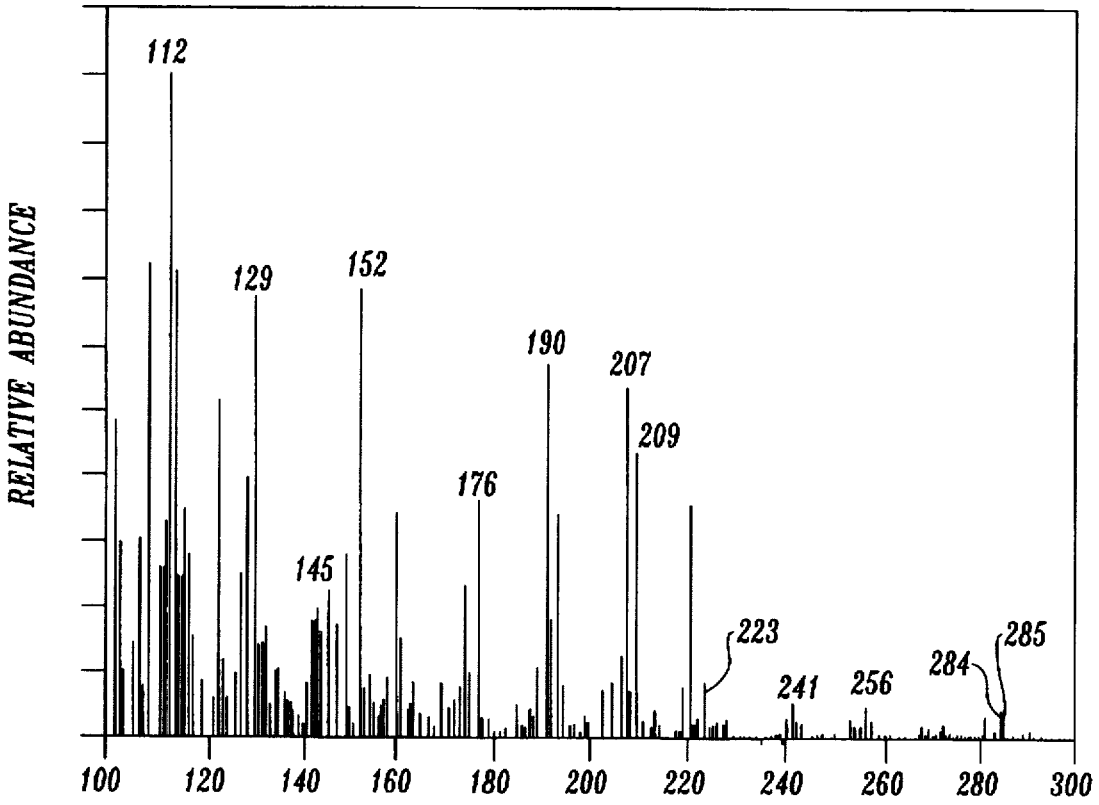
FIG. 3 is a mass spectrum of TNT reduced to 4-hydroxylamino 2,6- dinitronitrotoluene in accordance with the present invention.

Experiment 1 was repeated except that 2,4,6trinitrotolune (TNT) was used in the place of nitrobenzene. In this experiment, TNT was reduced to one major metabolite. TNT was not reduced under aerobic conditions. It was identified as 4-hydroxylamino 2,6- dinitronitrotoluene by mass spectrometry. The mass spectrum is shown in FIG. 3.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method for reducing nitroaromatic compounds comprising the steps of:

a) providing a nitroaromatic compound, b) providing an oxygen sensitive nitroreductase enzyme, c) combining said nitroaromatic compound and said oxygen sensitive nitroreductase enzyme in an environment substantially free of oxygen, thereby causing the catalytic reduction of said nitroaromatic compound.

2. The method of claim 1 further comprising the step of providing oxygen during said catalytic reduction thereby stopping the progress of said catalytic reduction and allowing the collection of a partially reduced product of said nitroaromatic compound.

3. The method of claim 1 wherein said nitroaromatic compound is selected from the group comprising nitrobenzene, orthochloronitrobenzene, orthoaminophenolonitrobenzene, 2,4,6-trinitrotoluene, dinitrotoluene, and combinations thereof.

4. The method of claim 1 wherein said oxygen sensitive nitroreductase enzyme is selected from the group comprising ferredoxin NADP oxidoreductase, xanthine oxidase, glutathione reductase and combinations thereof.

* * * * *